US005219116A

United States Patent [19]

Hearne

[11] Patent Number: 5,219,116

[45] Date of Patent: Jun. 15, 1993

[54] EASILY ATTACHED BAND FOR PIE BOXES

[76] Inventor: Kevin Hearne, Aljon Graphics, 1721 E. Lambert Rd., La Habra, Calif. 90631

[21] Appl. No.: 929,029

[22] Filed: Aug. 13, 1992

[51] Int. Cl.[5] ..... B65D 5/42

[52] U.S. Cl. ..... 229/118; 40/312; 206/459.5; 229/125.37; 229/125.39

[58] Field of Search ..... 229/117.19, 117.25, 229/118, 125.37, 125.39, 125.26, 125.28; 40/310, 311, 312; 206/459.5

[56] References Cited

U.S. PATENT DOCUMENTS

| | | | |
|---|---|---|---|
| 1,781,980 | 11/1930 | Isaacson | 40/312 |
| 1,895,258 | 1/1933 | Pent | 206/459.5 |
| 2,141,011 | 12/1938 | Monk | 229/125.39 |
| 2,192,423 | 3/1940 | Ward et al. | 40/312 |
| 2,250,666 | 7/1941 | Godefroy | 206/459.5 |
| 2,401,664 | 6/1946 | Robins | 229/117.19 |
| 2,638,210 | 5/1953 | Sparks | 229/117.25 |
| 3,196,021 | 7/1965 | Oas et al. | 229/125.26 |
| 4,103,820 | 8/1978 | Mathison et al. | 206/459.5 |
| 4,228,947 | 10/1980 | Eroyan | 229/118 |
| 4,238,070 | 12/1980 | Lyons | 229/118 |
| 4,472,895 | 9/1984 | Cillario | 229/118 |
| 4,603,809 | 8/1986 | Vilotte et al. | 206/459.5 |
| 4,779,733 | 10/1988 | Kilian | 206/459.5 |

FOREIGN PATENT DOCUMENTS

| | | | |
|---|---|---|---|
| 11611 | of 1905 | United Kingdom | 229/117.25 |
| 2180223 | 3/1987 | United Kingdom | 206/459.5 |
| 2233953 | 1/1991 | United Kingdom | 229/118 |

*Primary Examiner*—Gary E. Elkins
*Attorney, Agent, or Firm*—Edgar W. Averill, Jr.

[57] ABSTRACT

A decorative band which may be easily attached to pie boxes of the type which have a pair of locking flaps along the bottom of each side flap. The decorative bands is an elongated sheet having a center panel and two side flaps which overly the sides of the pie box. A pair of locking flaps are positioned at the base of each side flap of the decorative band so that it may be easily locked over a portion of the top and sides of a pie box.

2 Claims, 1 Drawing Sheet

EASILY ATTACHED BAND FOR PIE BOXES

BACKGROUND OF THE INVENTION

The field of the invention is containers and the invention relates more particularly to the type of containers which are commonly used to cover pies, cakes, and other bakery goods, although, of course, such boxes can also be used to contain other objects.

It is common for bakeries to sell pies, cakes, and other desserts and to place them in a cardboard box which has a pair of locking flaps along the bottom of each side flap of the box to hold the cover in an enclosed position. Such bakery items are often purchased by persons who wish to give them as a gift and it would be desirable for the box to include an appropriate salutation for the particular event for which the gift is intended to celebrate. For instance, a salutation such as "Happy Birthday" or "Congratulations" or "Happy Thanksgiving" would be typical messages which would make the gift more personalized.

In the past, stickers with an adhesive backing have been used. Cards with a pair of locking flaps are shown in U.S. Pat. No. 1,792,572 for personalizing a candy box. A decorative band is shown in U.S. Pat. No. 2,285,212. An advertising band which also assists in securing the cover in a closed position is shown in the U.S. Pat. No. 2,141,011.

SUMMARY OF THE INVENTION

It is an object of the present invention to provide a decorative band which can be selected from bands having various messages and easily attached to a box of the type which has a pair of locking flaps at the bottom of each side flap.

The present invention is for a decorative band which may be easily attached to boxes of the type which have a top which is integral with a back panel which top includes right and left side flaps. The side flaps have a truncated triangular locking flap which is inserted into similarly shaped openings at the base of the side panels of the box to hold the top in an enclosed position. The decorative band is an elongated sheet which has a center panel and two side band flaps. The side band flaps each have a locking tab which is the same shape as the locking tab on the box. The decorative band can then be easily placed over the top of the box, the side panel flaps are folded downwardly over the side flaps of the box and the locking tabs inserted in the locking openings to securely hold the band in place.

DESCRIPTION OF THE PREFERRED EMBODIMENTS

Figure 1:
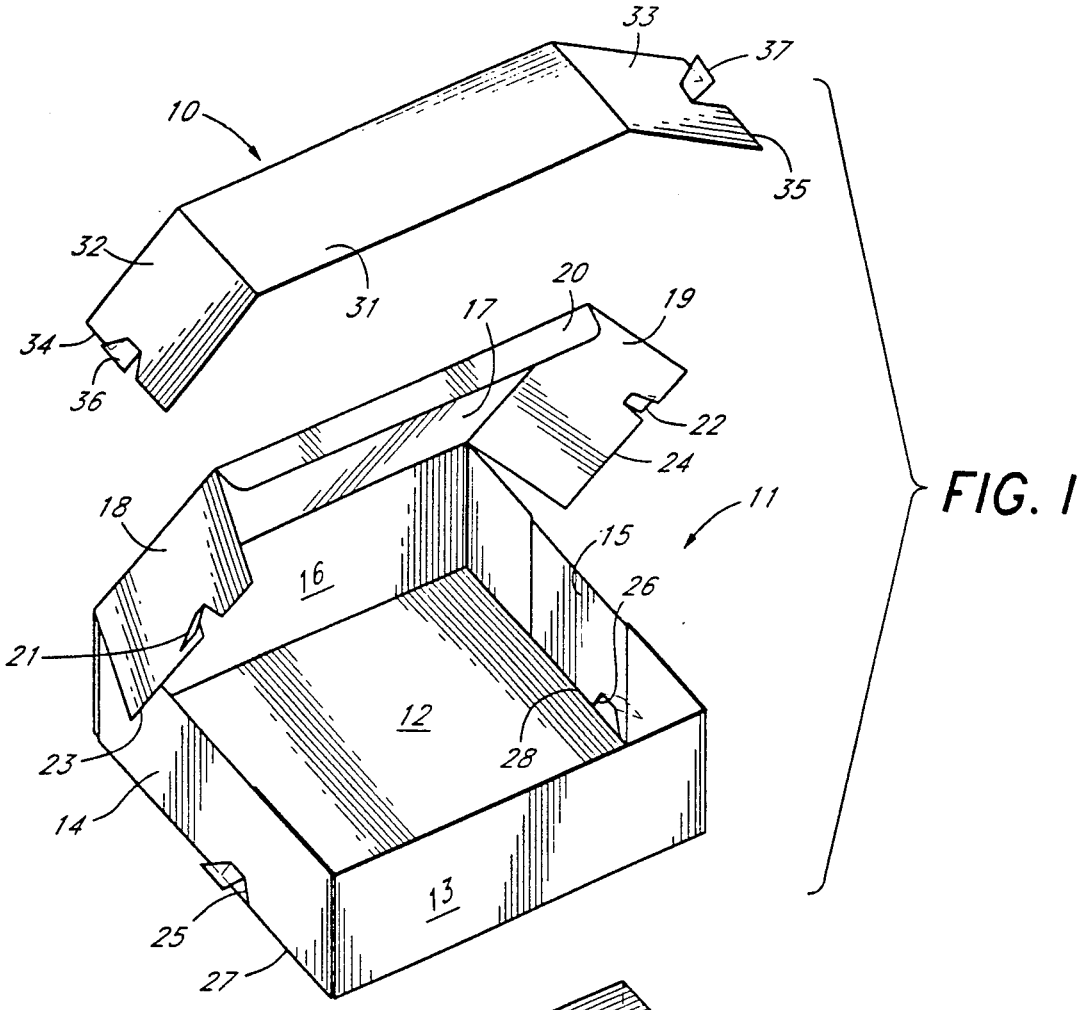
FIG. 1 is an exploded perspective view of a pie box and is the decorative band of the present invention.

A decorative band 10 is shown in FIG. 1 above a pie box 11. While the term "pie box" is used herein, it is, of course, understood that other boxes of the same kind of construction are also intended to be covered by the term "pie box". Box 11 has a bottom 12, a front panel 13, a left side panel 14, a right side panel 15, and a back panel 16. Box 11 is conventional and is of the type commonly used for pies or cakes in bakeries and restaurants. A top 17 is hinged to back panel 16, and has a left side flap 18 and a right side flap 19 and a front flap 20. A pair of truncated triangular locking flaps 21 and 22 are formed at the bottom edges 23 and 24 of left and right side flaps 18 and 19 respectively. Locking flaps 21 and 22 fit within truncated triangular locking flap openings 25 and 26 at the bottom edges 27 and 28 of left and right side panels 14 and 15.

The box is closed by inserting front flap 20 behind front panel 13 and placing the left and right side flaps 18 and 19 over the left and right side panels 14 and 15 and inserting locking flaps 21 and 22 in openings 25 and 26.

Figure 2:
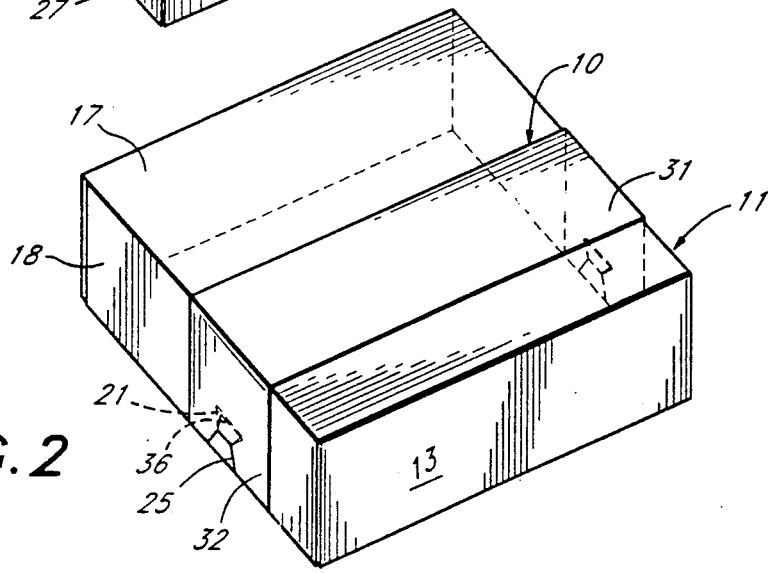
FIG. 2 is a perspective view of the box of FIG. 1 with the decorative band of FIG. 1 attached thereto.

In order to personalize the box, a decorative band 10 having appropriate indicia is selected. Band 10 has a center panel 31, a left side band flap 32, a right side band flap 33 which band flaps have bottom edges 34 and 35 respectively. A pair of truncated triangular locking flaps 36 and 37 are formed above bottom edges 34 and 35 and the side band flaps are sized with the center panel 31 to overly the top and side panels of pie box 11. The band is placed in the position shown in FIG. 2 and the locking flaps 36 and 37 inserted through the flap receiving openings 25 and 26 of box 11.

In this way, it is not necessary to stock boxes having numerous decorations and instead, many different decorative bands can be stocked and quickly selected and secured to the box to fit the appropriate occasion.

The decorative bands, of course, are fabricated from cardboard of the same general thickness as that used for the box itself. The band is easily removed by the purchaser as the box is opened. It is securely held in the same manner that the side flaps are held on the closed box by the shape of the locking flaps. While a rectangular band shown in the drawings, other shapes, of course, can be used as desired. While cardboard is suggested as a material of construction for decorative band 10, it can, of course, be formed from plastic, foamed material or other substances, although cardboard is believed most appropriate for most applications.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A decorative band attached to a pie box having a top which is integral with a back panel, which top has a width, a right side flap and a left side flap which flaps each have a bottom edge and overlie right and left side panels of the box, and the right side flap and the left side flap each has a height, a truncated triangular locking flap at the bottom edge of each of said flaps and said right side panel and said left side panel each having mating truncated triangular locking flap receiving openings at bottom edges of the right side and the left side panels, wherein the decorative band and box combination comprises:

an elongated sheet overlying said pie box having a front edge, a back edge, a center panel, a right side band flap and a left side band flap, each of said band flaps having a bottom edge, said center panel having the same width as the top of the pie box, and said side band flaps each having a height which is equal to the height of the right and left side panels; and a pair of truncated triangular locking flaps having the same size as the truncated triangular locking flaps of said right and left side panels, positioned along the bottom edge of the right and left side band flaps whereby after the pie box is closed and its locking flaps inserted in the truncated, triangular locking flap receiving openings, the elongated sheet may be placed over the closed pie box so that the center panel closely overlies a portion of the top of the pie box, the right and left side band flaps overlie a portion of the right and left side panels of the pie box and the truncated, triangular locking flaps of the right and left side panels may be inserted through the truncated triangular locking flap receiving openings of the pie box, securely and easily locking the decorative band to the pie box.

2. The decorative band and box combination of claim 1 wherein said elongated sheet is rectangular.

* * * * *